US009199818B2

(12) United States Patent
Bryl et al.

(10) Patent No.: US 9,199,818 B2
(45) Date of Patent: Dec. 1, 2015

(54) PADDLE WHEEL COMPILER

(71) Applicant: Xerox Corporation, Norwalk, CT (US)

(72) Inventors: Derek A Bryl, Webster, NY (US); Douglas K Herrmann, Webster, NY (US); Jason M LeFevre, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/242,900

(22) Filed: Apr. 2, 2014

(65) Prior Publication Data

US 2015/0284209 A1 Oct. 8, 2015

(51) Int. Cl.

| | |
|---|---|
| ***B65H 29/20*** | (2006.01) |
| ***B65H 31/36*** | (2006.01) |
| ***B65H 29/40*** | (2006.01) |
| ***B65H 29/22*** | (2006.01) |
| ***B65H 9/08*** | (2006.01) |
| ***B65H 9/10*** | (2006.01) |
| ***B65H 29/38*** | (2006.01) |
| ***B65H 31/02*** | (2006.01) |
| ***B65H 31/34*** | (2006.01) |

(52) U.S. Cl.

CPC ..... *B65H 31/36* (2013.01); *B65H 9/08* (2013.01); *B65H 9/10* (2013.01); *B65H 9/103* (2013.01); *B65H 9/106* (2013.01); *B65H 29/22* (2013.01); *B65H 29/38* (2013.01); *B65H 29/40* (2013.01); *B65H 31/02* (2013.01); *B65H 31/34* (2013.01); *B65H 2404/50* (2013.01); *B65H 2404/54* (2013.01); *B65H 2404/56* (2013.01); *B65H 2404/60* (2013.01); *B65H 2404/66* (2013.01)

(58) Field of Classification Search

CPC ..... B65H 9/08; B65H 9/10; B65H 9/103; B65H 9/105; B65H 9/106; B65H 29/22; B65H 29/24; B65H 29/241; B65H 29/242; B65H 29/243; B65H 29/38; B65H 29/40; B65H 2404/50; B65H 2404/54; B65H 2404/56; B65H 2404/60; B65H 2404/661; B65H 2301/44765; B65H 31/02; B65H 31/34; B65H 31/36

See application file for complete search history.

(56) References Cited

U.S. PATENT DOCUMENTS

| | | | | |
|---|---|---|---|---|
| 3,166,313 | A * | 1/1965 | Rehm | B65H 29/22 271/178 |
| 4,770,405 | A * | 9/1988 | Fukushima | B65H 29/40 271/176 |
| 5,065,997 | A | 11/1991 | Butts et al. | |
| 5,098,080 | A * | 3/1992 | Arnone | B65H 29/40 271/187 |
| 5,194,558 | A * | 3/1993 | Carlston | B65H 29/40 271/187 |
| 7,243,914 | B2 * | 7/2007 | Tokunaga | B65H 3/06 271/3.01 |
| 7,735,621 | B2 | 6/2010 | Hallowell et al. | |
| 2004/0070141 | A1 * | 4/2004 | Michels | B65H 29/22 271/220 |
| 2014/0231317 | A1 * | 8/2014 | Darmon | B65H 29/60 209/552 |
| 2014/0246827 | A1 * | 9/2014 | Kuypers | B65H 29/22 271/186 |

* cited by examiner

*Primary Examiner* — Prasad Gokhale

(57) ABSTRACT

A paddle wheel compiler includes a paddle wheel that accepts sheets from the front of the paddle wheel to form a set, unlike a disk stacker which accepts sheets from the top or back of the disk and flips the sheet. The paddle wheel compiler is unique in that it maintains control of all sheets in a set, except for the top sheet during tamping. The top sheet is registered to the set with side tampers, followed by a scuffing action to register the sheet against a registration wall in the process direction.

18 Claims, 2 Drawing Sheets

PADDLE WHEEL COMPILER

The present disclosure relates to printer that includes a compiler, and more particularly, to a paddle wheel compiler for stacking cut sheet media sets on top of a non-flat stack.

Past compilers include the disc stacker shown in EP 1762523 B1 for use in a finishing apparatus that employs rubber ring scuffers to register sheets against a registration wall. A variant disc stacker is shown in U.S. Pat. No. 5,065,997 in use as an inverter and stacking apparatus and includes at least one sheet inverter wheel having at least one arcuate sheet retaining slot into which a sheet may be inserted and flipped. A type of paddle wheel compiler that also flips currency is shown in U.S. Pat. No. 7,735,621 B2.

Cut sheet stacking requires sheets to be very accurately registered to one another in compiled sets. There are many architectures of stacking machines to accomplish this. One example is the use a compiler subsystem to stack and register the sheets of each set before adding the set to the main stack of paper. This type of machine also poses problems with sheet registration. Because each set is not compiled in a separate subsystem, which would provide a clean flat surface for each set, better sheet control is needed to deal with non-flat sheet compiling conditions. The non-flat conditions on top of the main stack can be due to a number of reasons including curl, cockle, static, etc., which generally accumulate as the height of the stack grows. The final goal is to compile sets with accurate in-set registration.

In-set registration is generally accomplished with any combination of the following features: pre-compiling registration, registration walls, tamping, and scuffing. The best results are usually the result of scuffing and tamping into a registration wall. However, scuffing and tamping have fundamental limitations: scuffing can only act on the top sheet of the set and tamping requires the sheets to be free of any forces impeding lateral motion. For example, the scuffer must be withdrawn from the set or it wouldn't allow the sheets to move laterally when tamping. In machines with a compiling subsystem, sheets can be tamped in the cross process direction as well as the process direction to ensure registration against a registration wall. However, when on a main stack, that may not be flat, several fundamental problems arise: (1) only the top sheet will be re-registered against the registration wall when the scuffer is actuated. The scuffer cannot correct sheets lower in the set and there is no trail edge tamper to correct those sheets; (2) sheets can move away from registration wall, in the process direction, during side tamping. This is because of the non-flat compiling surface, stack vibration, static levitation, etc., or any combination of these; and (3) there is no trail edge tamper to tamp the sheets against the registration wall in the process direction. A trail edge tamper cannot be used because there is no separation between the main stack and the set being compiled.

Therefore, there is still a need for a compiler that stacks cut sheet media sets on top of a non-flat stack, eliminates the compiler subsystem and compiles on the main stack of paper and has the advantages of lower cost and improved speed capability.

BRIEF SUMMARY

In answer thereto, provided hereinafter is a paddle wheel compiler that includes a paddle wheel which accepts sheets from the front of the paddle wheel, unlike a disk stacker which accepts sheets from the top or back of the disk and flips the sheet. The paddle wheel compiler processes multiple sheets in one revolution of the wheel and is unique in that it maintains control of all sheets in the set, except for the top sheet during tamping. The top sheet is registered to the set with side tampers, followed by a scuffing action to register up against a registration wall in the process direction.

The disclosed system may be operated by and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'sheet' herein refers to any flimsy physical sheet or paper, plastic, media, or other useable physical substrate for printing images thereon, whether precut or initially web fed.

As to specific components of the subject apparatus or methods, it will be appreciated that, as normally the case, some components are known per se' in other apparatus or applications, which may be additionally or alternatively used herein, including those from art cited herein. The cited references, and their references, are incorporated by reference herein where appropriate for teachings of additional or alternative details, features, and/or technical background. What is well known to those skilled in the art need not be described herein.

BRIEF DESCRIPTION OF THE DRAWINGS

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

Referring now to FIGS. 1 and 2, a compiler apparatus 8 is provided comprising a paddle wheel assembly 10 that includes a hub 12 that is rotatable by conventional means having a series of paddles 14 attached thereto. A plurality of flexible scuffer members 16 are positioned around the periphery of hub 12 along with damper hooks 18 with both the scuffer members and damper hooks being positioned in predetermined positions around hub 12. Hub 12 is conventionally supported above and adapted to rotate between openings (not shown) in registration wall 30 that is attached to an uneven sheet support member 40 that includes a first sheet set support surface 42 and a second sheet support surface 44. A vacuum transport 50 conveys sheets 11 in the direction of registration wall 30 and into a paddle indexing plate 20 which supports one paddle extending from hub 12 while another paddle is resting against the top of sheet stack 13 in order to present an opening for a sheet 11 to enter the paddle wheel assembly. In addition, the paddle 14 resting on top of the stack, below the sheet being compiled, maintains a normal force and friction force to the set or stack 13. This prevents previously registered sheets in the set from shifting. Thus, providing control of the set while allowing the top sheet to be free for tamping. An entrance guide 22 directs sheets 11 against a paddle resting against the top of sheet stack 13.

Figure 1:
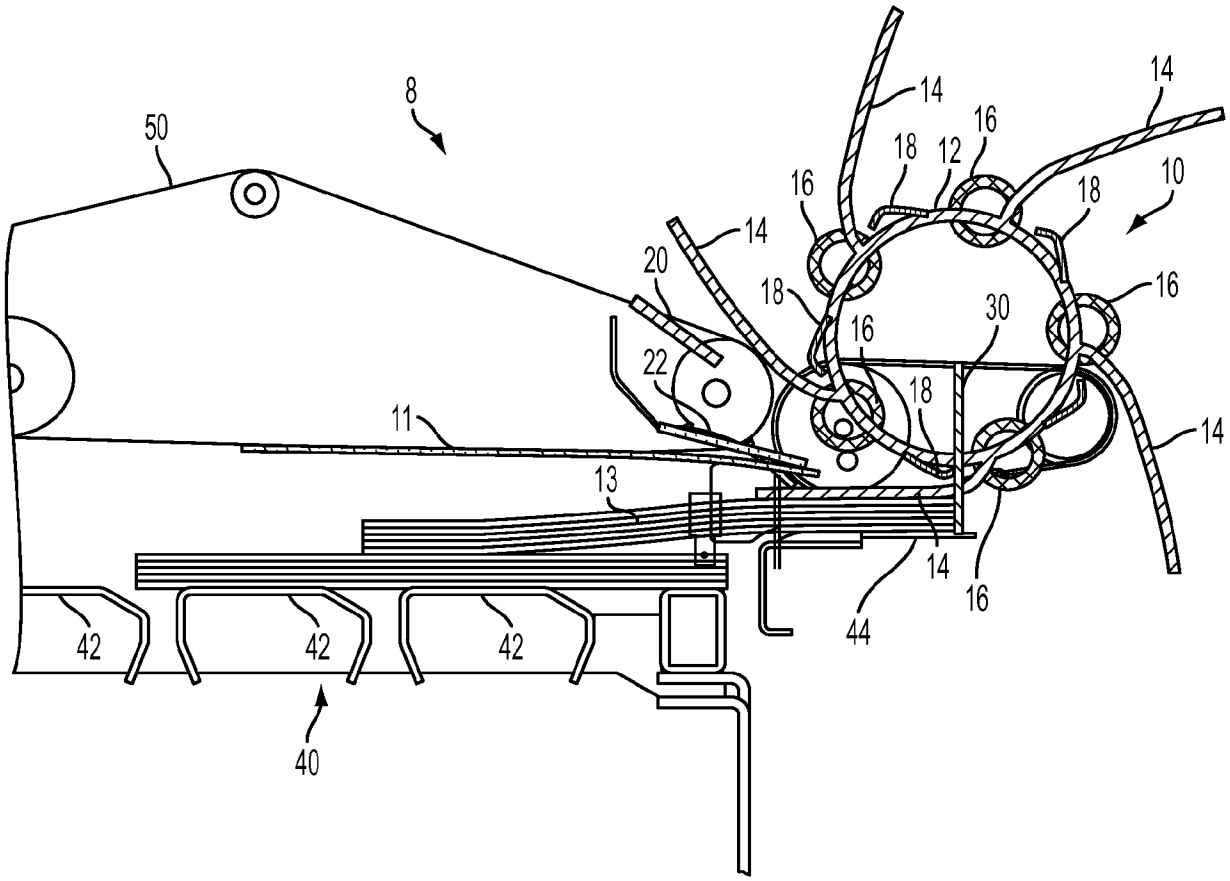
FIG. 1 is a partial, frontal view of an exemplary compiling apparatus in accordance with the present disclosure.
Figure 2:
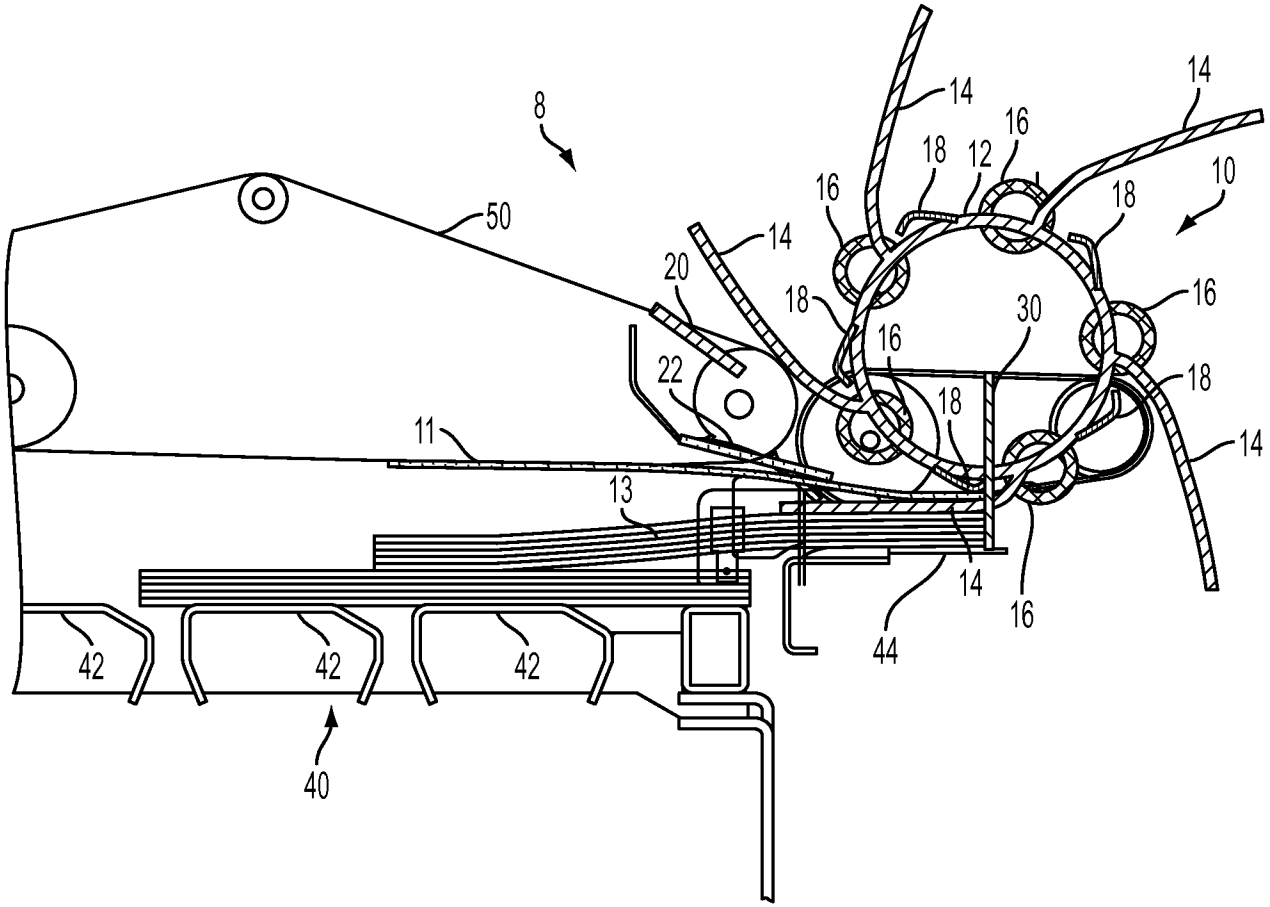
FIG. 2 is a partial, frontal view of the exemplary compiling apparatus in FIG. 1 with the lead edge of a sheet driven under a damper hook and held in place by friction force.

In operation, paddle wheel assembly 10 parks with one paddle 14 on top of sheet stack 13 and one paddle 14 restrained against indexing plate 20 in order to create an opening for a sheet 11 to enter the paddle wheel compiler 8. Damper hook 18 is parked in front of registration wall 30, awaiting sheet 11 to be driven underneath it. Sheet 11 is then fed by vacuum transport 50 into the opening created between a paddle 14 on top of stack 13 and the paddle retrained by indexing plate 20 with the lead edge of sheet 11 being driven under damper hook 18 and held in place by friction force. Paddle wheel assembly 10 is then rotated until damper hook 18 drags sheet 11 into registration wall 30 on top of paddle 14 that is on top of stack 13 and strips off the sheet as it passes behind the registration wall. The sheet is now registered to the registration wall and the damper hook 18 has moved off the sheet to allow side tamping by conventional means (not shown). Sheets already registered in the set are maintained in position up against registration wall 30 by the paddle 14 on top of the set providing normal force and friction force to hold the set in place. The side tampers close on the sheet/set to register sheets in the cross process direction. The sheet being compiled has the potential to drift away from the registration wall during tamping, however, this is addressed as the paddles 14 and scuffer 16 re-register the sheet to the registration wall as a last stage of the tamping operation. Once sheets are registered in the set, there is always normal and friction force from at least one paddle on top of the set, thereby eliminating a requirement for a trail edge tamper. That is, paddle wheel assembly 10 allows for the sheet being compiled to be scuffed upon entrance to compiler 8 and again at the end of tamping to maintain registration with the registration wall 30.

In recapitulation, a paddle wheel assembly 10 is disclosed that rotates while tampers are in the closed position and a paddle 14 that is being restrained on top of paddle indexing plate 20 drops down on top of sheet 11. A scuffer 16 is rotated by paddle wheel assembly 10 into contact with the now top sheet of stack 13 to register the sheet against registration wall 30. Continued rotation of paddle wheel assembly 10 strips the paddle 14 from between top sheet and the rest of the sheet set or main stack and side tampers are actuated to maintain cross process registration. Afterwards, the side tampers are opened and paddle wheel assembly parks with a damper hook 18 parked just before registration wall 30 to repeat the sheet registration process as a job requires.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A compiler apparatus, comprising:

a registration wall that is attached to an uneven sheet support member, said sheet support member being adapted to support a sheet set resting thereon;

a paddle wheel assembly, said paddle wheel assembly including a rotatable hub having a plurality of paddles attached thereto, said rotatable hub being supported above and adapted to rotate between openings in said registration wall;

a plurality of flexible scuffer members positioned around a periphery of said rotatable hub;

a plurality of damper hooks positioned in predetermined positions around said rotatable hub; and a paddle indexing plate adapted to support one paddle extending from said hub while another paddle extending from said hub simultaneously rests against a top sheet of a sheet set in order to present a space for a sheet to enter between said one paddle and said another paddle.

2. The compiler apparatus of claim 1, including a vacuum transport configured to convey sheets in the direction of said registration wall and against an entrance guide member.

3. The compiler apparatus of claim 1, wherein said sheet enters said opening in said paddle wheel assembly and exits said paddle wheel assembly in an un-flipped orientation.

4. The compiler apparatus of claim 1, wherein said damper hooks controls sheets from bouncing off said registration wall in addition to supplying a scuffing functionality.

5. The compiler of claim 4, wherein said flexible scuffer members provide for re-registration of said sheet against said registration wall.

6. The compiler of claim 5, wherein said uneven sheet support member includes a first sheet set support surface and a second sheet support surface.

7. The compiler of claim 1, wherein said sheet is inserted between two of said plurality of paddles extending from said hub from a front position thereof.

8. The compiler of claim 7, wherein only said sheet will be re-registered against said registration wall when said scuffer members are actuated.

9. The compiler of claim 8, wherein said paddle of said hub simultaneously resting against said top sheet of said sheet set below the sheet being compiled maintains a normal force and friction force to said set, thereby preventing previously registered sheet in the set from shifting.

10. The compiler of claim 1, wherein said compiler apparatus is incorporated into a xerographic device.

11. A method for stacking cut sheet media sets on top of a non-flat media stack, including:

providing a non-flat media support surface;

providing a rotatable paddle wheel that accepts cut sheet media from a front position with respect to said rotatable paddle wheel and deposits said cut sheet media upon said non-flat media support surface;

providing multiple paddles extending from a hub of said rotatable paddle wheel and placing said cut sheet media one each between pairs of said multiple paddles in one revolution of said paddle wheel;

placing said cut sheet media upon said non-flat media support surface to form a set;

maintaining control of all sheets of said cut sheet media in said set including conforming a major portion of each of said multiple paddles along a top surface of said set during rotation of said paddle wheel;

placing a sheet onto a top surface of one of said multiple paddles while simultaneously placing a bottom surface of said one of said multiple paddles on top of said set; and scuffing each sheet of said cut sheet media against said a registration wall in a process direction in order to register said cut sheet media.

12. The method of claim 11, including configuring said paddle wheel to prevent flipping of said cut sheet media by said paddle wheel.

13. The method of claim 11, including providing a scuffer member in close proximity to each of said multiple paddles.

14. The method of claim 13, including providing damper hooks for dragging said cut sheet media into said registration wall and stripping off said cut sheet media as said damper hooks pass through openings in said registration wall.

15. The method of claim 14, including providing one of said damper hooks in close proximity to each of said multiple paddles.

16. The method of claim 15, including attaching each of said scuffer members and damper hooks to said hub.

17. A paddle wheel compiler for stacking cut sheet media sets, comprising:

a non-flat media support; a rotatable paddle wheel that accepts cut sheet media from a front position with respect to said rotatable paddle wheel and deposits said cut sheet media upon said non-flat media support surfacc without flipping said cut sheet media;

a hub for supporting said paddle wheel including multiple paddles extending from said hub, and wherein multiple paddles of said rotatable paddle wheel are adapted to receive said cut sheet media one each between pairs of said multiple paddles in one revolution of said rotatable paddle wheel and deposit said cut sheet media upon said non-flat media support to form a set; and a paddle indexing plate adapted to support one paddle extending from said hub while another paddle of said hub simultaneously rests against a top of a sheet set in order to present an opening for a sheet to enter between said one paddle and said another paddle.

18. The paddle wheel compiler of claim 17, including a plurality of damper hooks positioned in predetermined positions around said hub.

* * * * *